United States Patent [19]

Hannah

[11] Patent Number: 4,748,786

[45] Date of Patent: Jun. 7, 1988

[54] FABRICATED OPEN WEB STEEL JOIST, AND MANUFACTURE THEREOF

[76] Inventor: William J. Hannah, 1470 Williamsport Dr., Mississauga, Ontario, Canada, L4X 1T5

[21] Appl. No.: 85,948

[22] Filed: Aug. 17, 1987

[51] Int. Cl.[4] ..... E04C 3/02

[52] U.S. Cl. ..... 52/694; 52/721; 52/730

[58] Field of Search ..... 52/664, 721, 690–694, 52/730–732

[56] References Cited

U.S. PATENT DOCUMENTS

| | | | |
|---|---|---|---|
| 1,915,424 | 3/1928 | Kerr | 52/691 |
| 1,983,632 | 11/1931 | Miller et al. | 52/694 |
| 2,459,037 | 1/1949 | McIntosh | 52/376 |
| 2,578,465 | 12/1951 | Davis, Jr. et al. | 52/691 |
| 2,624,430 | 6/1949 | Macomber | 52/694 |
| 2,662,272 | 12/1953 | Macomber | 52/694 |
| 3,062,341 | 11/1962 | Klaus | 52/694 |
| 3,362,121 | 1/1968 | Weber | 52/334 |
| 3,639,962 | 2/1972 | Gooder | 29/155 R |
| 4,207,719 | 6/1980 | Knowles | 52/693 |
| 4,569,177 | 2/1986 | Ottinger | 52/650 |

*Primary Examiner*—David A. Scherbel
*Assistant Examiner*—Andrew J. Rudy
*Attorney, Agent, or Firm*—Donald E. Hewson

[57] ABSTRACT

A fabricated open web steel joist is provided. The top and bottom chords of the joist are each formed of L-shaped angles, arranged in back-to-back relation; and the web is formed of a plurality of W-shaped pre-formed bar sections. Adjacent ends of each of the "W"'s are located between the opposed faces of the top chord. If the joist requires an odd number of panels, a "V" (a one-half "W") is inserted between two W's within the length of joint, usually at the center thereof. The joist is welded, with each end and each apex of each "W" and "V" being welded to each of the chord components. The assembly of the joist includes the jig assembly and clamping of all of the components of the joist, welding only the adjacent ends of the "W"'s (and "V", if used) and the apexes of the "W"'s in the upper chord first, inverting the still clamped assembly, and welding the now upper located apexes in the bottom chord. The welding is carried out in a vertical-up manner, in each instance.

5 Claims, 4 Drawing Sheets

FABRICATED OPEN WEB STEEL JOIST, AND MANUFACTURE THEREOF

FIELD OF THE INVENTION

This invention is directed to fabricated open web steel joists, and to the process of manufacture of the joists. More particularly, this invention is directed towards a fabricated open web steel joist whose web comprises a plurality of pre-formed W-shaped bar sections, and their assembly. The manufacture of the joist, in keeping with other aspects of the present invention, provides accurate placement and forming, and welding, in a cleaned jig, with a minimum of handling and a minimum of distortion occuring during assembly.

BACKGROUND OF THE INVENTION

The use of the fabricated open web steel joists is very common in the building and construction industry. Such joists may be provided over a wide range of flexibility as to design and weight of components, depending on the intended use. However, it is incumbent upon the manufacturer to provide the fabricated joists to its customer as economically as possible, and preferably with a minimum of set-up time and costs in the factory. Even after the set-up has been made, it is a feature of the present invention that there is minimum handling, and maximum ease of fabrication, thereby minimizing worker fatigue.

To accomplish the fabrication of a more superior joist, the provision is made by the present invention for the joist to be assembled in a vertical orientation—that is, with top and bottom chord of the joist horizontally disposed one above the other. Moreover, the invention provides for the inversion of the joist during its assembly process, while still in a jig, for even greater ease of manufacture and for better quality welding.

The fabricated open web steel joist of the present invention has a top chord, a bottom chord, and a web extending between them. Each of the top and bottom chords comprises a pair of generally L-shaped angles which are arranged in back-to-back relation. One leg of each "L" is horizontally disposed, at the upper extremity or the lower extremity of the joist, and the other leg of each of the "L"'s are arranged, in pairs, in opposed vertically disposed manner.

The web comprises a series of pre-formed bar sections, each of which has the general configuration of a "W". The ends of the sections are located in the top chord, in adjacent positions except at the outer ends of the joist. Each "W" spans two panels along the length of the joist; so that, where necessary because of there being an odd number of panels required in the length of the joist, a "V" may be inserted between two of the W-shaped sections within the web—usually at the centre thereof. The joist is welded, where each end and each apex of each "W" and "V" which is included in the joist is welded to each of the vertically disposed faces of the L-shaped angles that form the top and bottom chords of the joist.

The subject construction is clearly distinguished over the prior art, which in respect of open web joists generally require the use of serpentine web bar members. Such prior art includes U.S. Pat. No. 1,915,424 issued in June, 1933 to KERR; U.S. Pat. No. 1,983,632 issued in December of 1934 to MILLER et al; U.S. Pat. No. 2,624,430 issued in January, 1953 to McCORMBER et al; and U.S. Pat. No. 3,639,962 issued in February, 1972 to GOODER. Each of the prior art patents noted above shows that a continuous web member is used, formed in a serpentine manner, and that the web member extends substantially along the full length of the joist. This creates a number of problems, particularly during assembly of such joists. Indeed, one such problem is that the end compression leg of certain prior art joists is vertical or nearly so, making its welding into place difficult to achieve—thereby usually dictating that the joist is turned on its side for fabrication.

For example, handling the material of the prior art webs is difficult, due to their own length, and due to the slenderness of the web member which may be formed of relatively light material. Not only may a prior art web be accidentally distorted, the mere act of welding it—usually when horizontally disposed because otherwise it is too difficult to handle—will cause deformation.

The process of fabrication of open web steel joists, according to this invention, includes the steps of:

(a) pre-forming a plurality of bar sections, each in the general form of a "W", each of which will cover two panels along the length of the joist; and in the event that an odd number of panels is required, pre-forming a bar section in the general form of a "V";

(b) assembling the top chord components, bottom chord components, and pre-formed bar sections in a jig, so that the joist is completely assembled as to the required components for its fabrication, and clamping the jig to maintain the assembled components in place; and (c) welding the clamped components so as to form a fabricated joist.

Generally, step (c) is carried out in three individual steps, namely:

(c)(i) welding the ends and apexes of the pre-formed sections which are between the opposed faces of the top chord;

(c)(ii) inverting the still-clamped assembly of the components and jig; and (c)(iii) welding the now upper located apexes of the pre-formed sections which are between the opposed faces of the bottom chord.

Because of the inversion of the joist during its assembly, the present invention provides for a much more economical assembly or fabrication line for welded open web steel joists, reducing handling and labour costs, and increasing flow-through time by the simple expedient of never reversing the direction of flow of the joist while being fabricated, or even rotating the joist in an end-to-end fashion. Still further, the present invention provides, by assembly and welding of the joist in a vertical position, for a joist having very little "sweep" or side-to-side distortion along its length. Even further, by assembly using a jig which supports the joist, and which inverts it, the joist can be manufactured with essentially no camber from end to end, or with a predesigned camber as required. The support of the joist in the jig may be at the centre point, but more usually is at the outside quarter points (i.e., one-quarter of the length of the joist in from each end). This manner of support assures that there will be no significant sag in the joist, because the turning moments in the joist about the support points are balanced.

The welding technique used, according to the present invention, is designated as "vertical-up", and as such it is a technique which is easily performed by welders in a standing position without having to distort their own bodies or to weld above the welding gun. More particularly, the use of a vertical-up welding technique permits both sides of the web element to be welded at the same time, thereby eliminating or effectively precluding undue distortion in the joist. The weld wire can be inserted into the space between the opposed vertically disposed faces of the chord member which is in the upper orientation at any time, and a vertical-up weld can be made on each side of the apex or adjoining ends of "W"'s within the web of the joist.

By using preformed web sections, all of which are symmetrical in the form of a "W" (or, one-half of the symmetry of a "W" when in the form of a "V"), the handling and placement of the web members is very efficient. Because the overall height and length of each web member is the same as those of all other web members (or one-half, in the case of a "V"), the jig may be arranged with equal panel lengths along the entire length of the joist, with each W-shaped web member covering two panel lengths. By virtue of the design of the web members, they may be so placed in an accurate manner that no significant accumulated error occurs along the length of the joist. Moreover, even though it is possible to design a joist having varying panel spans so as to take advantage of low shear requirements at differing points along the joist, the cost of calculating and re-setting the machinery to bend the rod material which forms the web is generally far greater than the savings that may be accomplished by using slightly less material.

When a joist is designed in keeping with the present invention, in a simple manner such that its fabrication reduces the number of manufacturing steps and operations to a minimum, and such that there is no backtracking or reversal of the direction of flow of the material during fabrication of the joists, then significant economies may be achieved. Moreover, economies of the savings of material can be achieved if a joist requirement varies from another joist requirement simply in the load bearing capacities, by substituting lighter chord material and/or bar material of a smaller cross section, but still having the same panel lengths and therefore the same pick-up points and jig points in the tooling. This reduces the cost of cutting and forming the bar material, as well as the cost of handling the pre-formed web sections.

For example, balanced web sections that are each generally in the form of a "W" can be suspended from their central apex over a single support, and many such pre-formed sections may be moved at any one time. Sections in the form of a "V", when needed, may also be easily handled by suspending them in an inverted condition from a single support. Of course, all of the included angles between the legs of a "W" or a "V", and therefore also the included angle between the end-most legs of adjacent bar sections, are equal in any one joist design. That being the case, the joist design is easily calculated by knowledge of its load bearing requirements, and by designing the joist as to the top and bottom chord members and as to the height of the web and the cross sectional area of the web section components (which may comprise tension or compression members under load), as well as the height of the joist. All of those matters having been decided, the length of the joist may be divided into a convenient number of panel lengths, which may be an even number or an odd number. As noted, if the number of panel lengths is even, then only W-shaped sections would be used; if the number of panel sections is odd, then one V-shaped web section would be used and would be placed along the length of the joist, generally at the centre thereof.

Because the joist is fabricated by welding, using a gently sloping vertical-up welding technique, which may be done at a convenient height, the welders who are doing the actual fabrication will experience a minimum of fatigue. Also, the welding steps using vertical-up techniques mimimize the localized heat distortion of the joist components as noted above, so that the sweep (sideways distortion or bowing) of the joist is minimized. The current standards of sweep require that the sweep be no greater than 1/500th of the joist span; and where the joists are being placed in such a manner that steel erectors must rely on the joist placement for connecting or placing yet other members, particularly such as galvanized steel decking, on them, it may be dangerous or unacceptable practice if the joists have too much bow or wander in them. Using joists of the present invention, however, accurate centre-to-centre distances of adjacent joists may be maintained, thereby realizing yet further economies in erection of the structure being built, as well as assuring sound engineering structures which are in keeping with the design drawings for that structure.

The usual manner of fabrication of joists according to the present invention presumes that the web bars are cut and formed in a bender which may be dedicated for that purpose. Of course, as mentioned above, the amount of bend as to the included angle and as to the height of the web section may vary from joist design to joist design, with minimal tool set-up time required. Similarity, the L-shaped chord angles that comprise the top and bottom chords of the joist when assembled, would be pre-cut and spliced where necessary to the appropriate length; and they may well have the bearing shoes which are required for the joist attached to them, prior to their delivery to the joist jig.

By another aspect of the present invention, the joist jig is normally supported as noted above on a positioner and inverter, thereby effectively eliminating sag in the joist. In any event, by supporting the joist jig and the components of the joist as noted, a pre-calculated camber for the joist may be accommodated. At the same time, using a joist positioner and inverter, together with the jig and clamping arrangements to maintain the components in place until the joist is fully fabricated, allows the positioner and inverter to be loaded from one side and unloaded from the other side without the requirement to rotate or upend the joist.

Obviously, fully welded joists, when removed from the joist inverter, may be carried singly or in bundles for further processing including pickling where necessary, paint tank dipping, draining, tagging and marking, and loading onto trailers for delivery to the job site.

The method of fabrication according to the present invention, therefore, allows for material handling using generally standard equipment which would normally be found in a steel fabricating shop, such as overhead cranes and jib cranes, as well as easily fabricated jigs, buggies, racks, and tables.

It has been determined that, by using vertical-up welding techniques, higher welding voltage and current can be employed without creating a risk of damage to the L-shaped angle sections that comprise the chords of the joist. Moreover, if the welding were to be carried out horizontally with the joist on its side rather than in the vertical-up manner, more handling steps would be required, at the costs of both labour and time.

BRIEF DESCRIPTION OF THE DRAWINGS

Particular features of the present invention, both as to the structure of joists in keeping with the invention and the assembly or fabrication of such joists, will be discussed hereafter in association with the accompanying drawings, in which.

DESCRIPTION OF THE PREFERRED EMBODIMENTS

Figure 1:
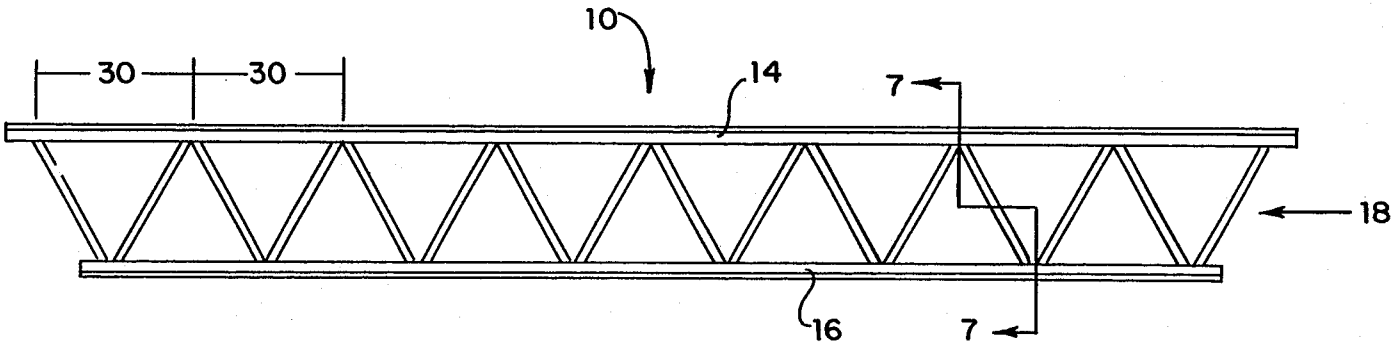
FIG. 1 is an elevation of a typical joist according to the present invention, having an even number of panels in its length.
Figure 2:
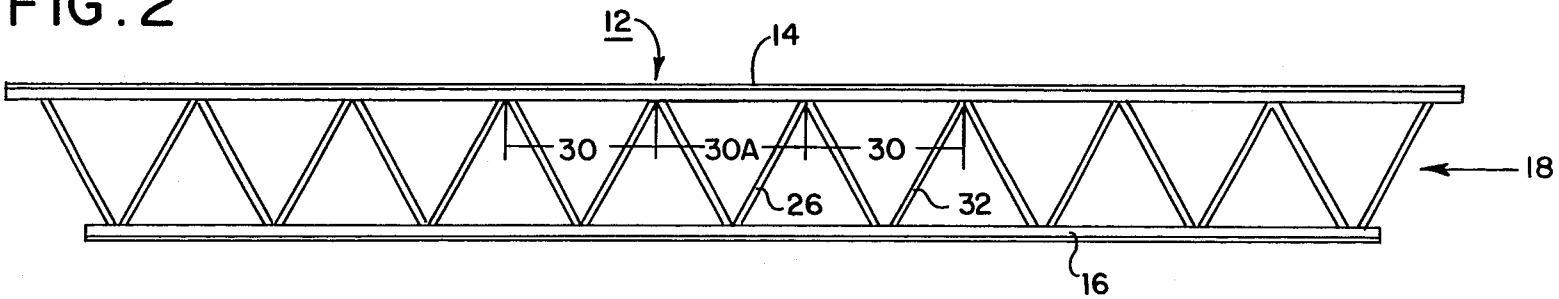
FIG. 2 is similar to FIG. 1, but shows a joist having an odd number of panels in its length.
Figure 7:
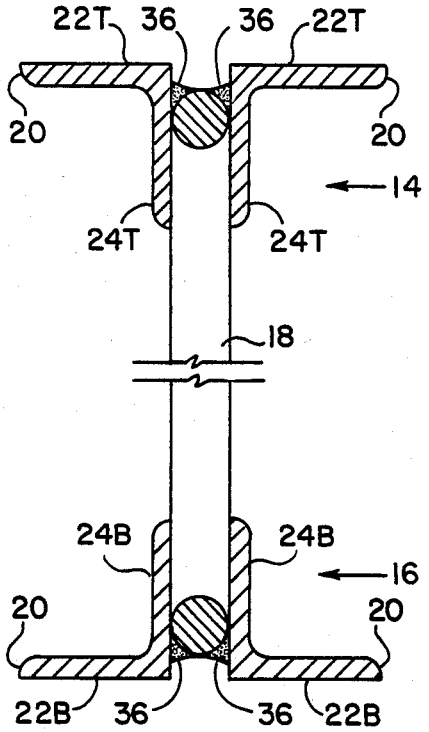
FIG. 7 is a typical cross section such as that taken in the direction of arrows 7—7 in FIG. 1.

A fabricated open web steel joist, such as that shown at 10 in FIG. 1, or 12 in FIG. 2, has a top chord 14, a bottom chord 16, and a web shown generally at 18. As shown in FIG. 7, each of the top and bottom chords 14 and 16 comprises a pair of generally L-shaped angles, each indicated by the single reference numeral 20. As seen in FIG. 7, the angles are each arranged in back-to-back relation. One leg of each of the L-shaped angles 20 is horizontally disposed, as shown at 22 in FIG. 7. The designation 22T is used for the top chord, and 22B for the bottom chord, thereby showing the disposition of those horizontal legs 22 at the upper or lower extremities, respectively, of the top chord 14 and the bottom chord 16. The other legs of the angles 20 are designated 24, using the same convention as noted above, and they are vertically disposed in opposed face-to-face relation in each chord.

Figure 6:
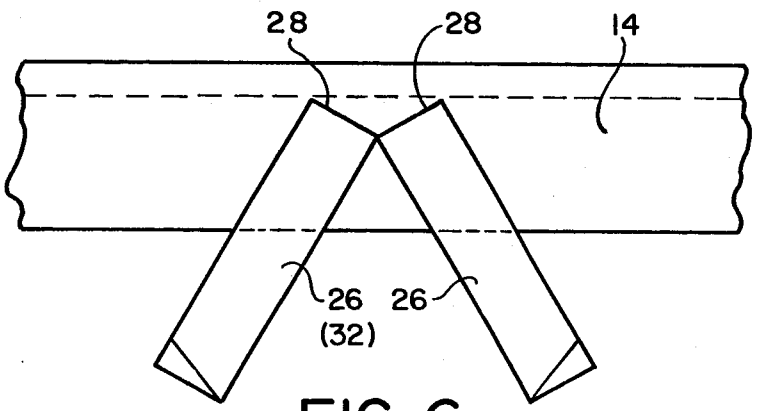
FIG. 6 is similar to FIG. 5 except that it shows the placement of the end legs of two adjacent square web section members.

The web 18 is located between the vertically disposed opposed faces of the legs 24T of the angles of the top chord 14, and between the vertically disposed opposed faces of the legs 24B of the bottom chord 16, in the regions of each. Obviously, the web 18 is disposed vertically between the chords 14 and 16, with the legs thereof being directed downwardly at an angle within the plane of the web. The web is comprised of a plurality of pre-formed bar sections, and may be formed of round bar as illustrated in FIG. 7, or square bar as is shown in FIG. 6. In any event, each of the pre-formed bar sections generally has the shape or configuration of a "W", as shown at 26 in FIG. 3. The ends 28 of the "W" sections are located in the top chord 14, in adjacent positions as shown in FIG. 6—except, of course, at the outer ends of the joist.

Figure 3:
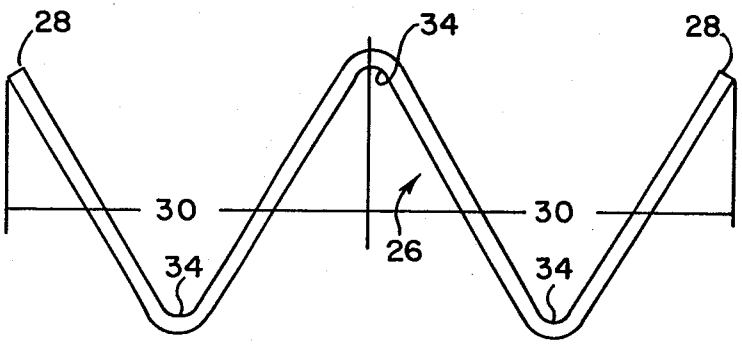
FIG. 3 is an illustration of a typical W-shaped web section which is used in keeping with the present invention.
Figure 4:
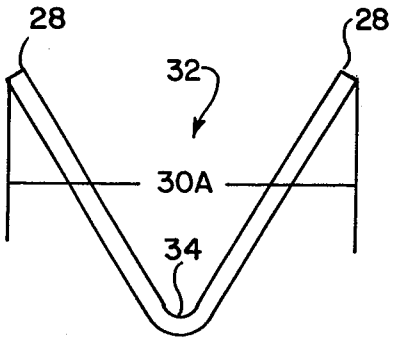
FIG. 4 is an illustration of a one-half "W", i.e., a "V" which is used in keeping with the present invention.

Each "W" spans two panels along the length of the joist, each panel being designated at 30 in FIGS. 1 to 3; a panel 30A being also shown in FIGS. 2 and 4, and discussed hereafter. As indicated in FIG. 3, each "W" spans two panels 30; so that, where there are an even number of panels along the length of the joist, as there are in FIG. 1, the number of W-shaped pre-formed web sections that are used to fabricate that joist is one-half of the number of panels 30.

Occasionally, it will occur that there is an odd number of panels in the length of the joist, in which case a V-shaped element 32, as shown in FIG. 4, is inserted between two W-shaped elements 26 within the length of the joist. The V-shaped element 32 spans a panel 30A, whose length is the same as a panel 30, and usually the V-shaped element 32 is placed at the centre of the joist as shown in FIG. 2. Thus, one of the elements 26 which is illustrated in FIG. 6, having its end 28 adjacent the end 28 of a further element 26, may in fact be substituted by an element 32, also as indicated in FIG. 6.

Figure 5:
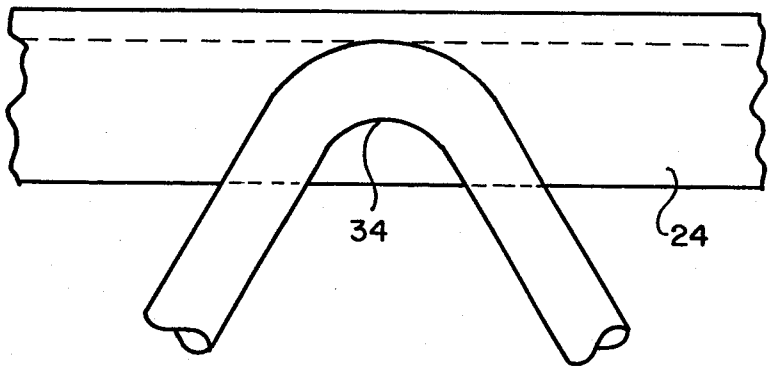
FIG. 5 is a detail of the placement of an apex of a "W" or "V" in a chord, according to the present invention.

Each element 26 or 32 has at least one apex 34. Each upper apex 34 of an element 26, and each end 28 of elements 26 and 32, is welded to each of the legs 24T of the top chord. Each of the lower apexes 34 of elements 26, and of the apex 34 of element 26 when used, is in the region of the bottom chord 16 and is welded to the legs 24B thereof. FIG. 5 generally shows the placement of an apex 34 against a face 24, and is thus representative of such placement in either a top chord or a bottom chord.

It is important to note the similarity between FIGS. 5 and 6. Principally, they show that the centre lines of the individual legs of the bar elements may intersect above the chord or at the surface of the chord, but the difference is sufficiently small and is sufficiently well calculated that the placement of the apexes 34 or adjacent ends 28 along the length of the joist can be accurately determined. This precludes any significant accumulated error in placement of the web, and thus in the placement of the compression and/or tension elements of the web within the joist (depending on the design and the use to which the joist will be put). In any event, the included angle between adjacent legs of any W-shaped element 26 or between the legs of a V-shaped element 32, or between adjacent legs of adjacent sections (as shown in FIG. 6) is in each case substantially equal to all other such angles in the same joist. Generally, that angle is in the range of from 40 degrees to 90 degrees.

During fabrication of the joist, the pre-formed bar sections 26 (and 32, when used) are assembled together with the pre-cut top chord and bottom chord components in a jig. The joist is therefore completely assembled, as to the required components for its fabrication, and the jig is clamped so as to maintain the assembled components in place. Then, the clamped components are welded so as to form the fabricated joist.

As noted above, generally the design of the joist is such that the adjacent ends of the pre-formed bar sections 26 and 32 are all located in the top chord 14.

Figure 8:
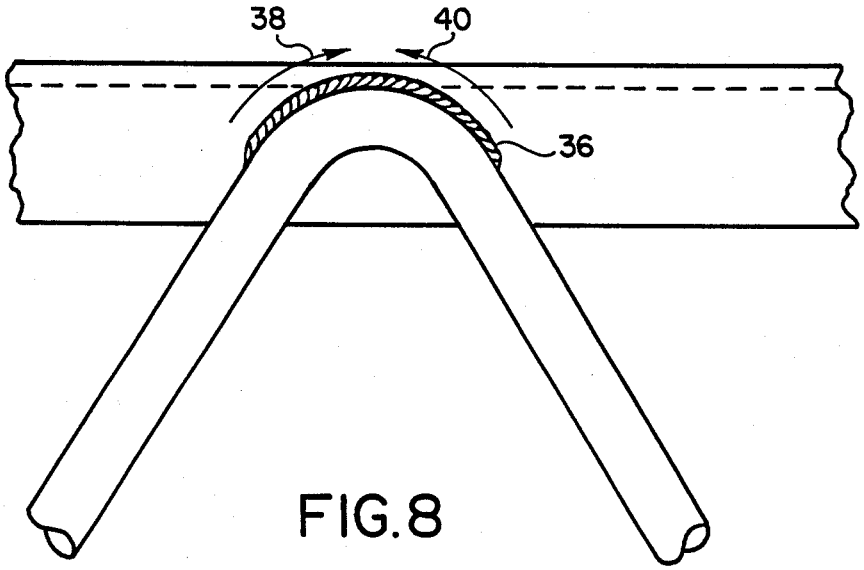
FIG. 8 is similar to FIG. 5, showing the weldment made during fabrication of a joist according to the present invention.

The welding is made such that welding beads 36 are placed as shown in FIGS. 7 and 8. However, in keeping with one aspect of the invention, a certain technique is employed to place the welds 36.

Generally, the welding is accomplished in a vertical-up manner. That means that the joist is vertically situated, that the weld is made in the upper portion of the joist (the joist is inverted to always keep the welding in the upper orientation of the joist, as placed), and the weld is formed from its lower extremity up to the top of the weld placement. The arrows 38 and 40 in FIG. 8 thereby show the nature, placement, and direction of the weld which, when finally in place, is shown at 36. It is evident that, by following the vertical-up welding technique, no unfilled weld craters are left. In practice, the first weld is carried slighly past the centre, and the second weld is then lapped over it at the centre.

Figure 9:
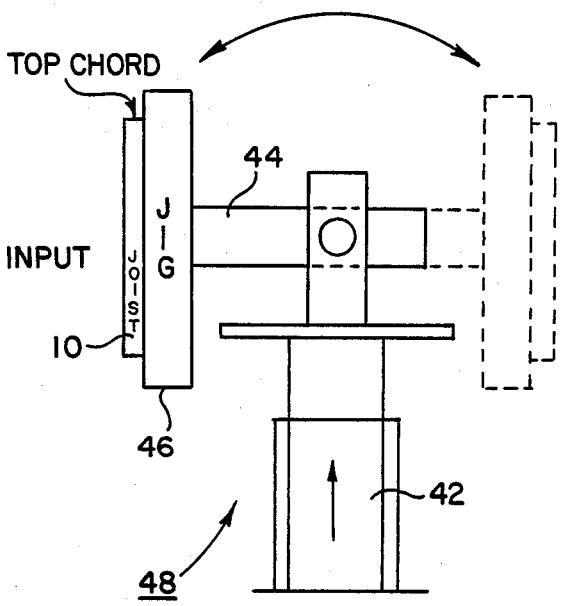
FIG. 9 is a schematic illustration of the use of a jig and joist inverter during fabrication of a joist in keeping with the present invention.

Turning to FIG. 9, a joist positioner and inverter apparatus 48 is schematically illustrated, including a pedestal 42, an inverter arm 44, and a jig 46. A joist 10 is shown as being secured to the jig 46. On the input side of the inverter 48 shown in FIG. 9, at the left side thereof, the top chord of the joist is in the upper orientation. When all of the apexes and bar element ends have been welded in the top chord, at the input side of the inverter, the joist is then inverted as shown in dashed lines at the right side of FIG. 9. Then, the top chord is in the bottom orientation, and the bottom chord is at the top orientation of the joist; and the apexes within the bottom chord are then welded using the same technique as described above.

Figure 10:
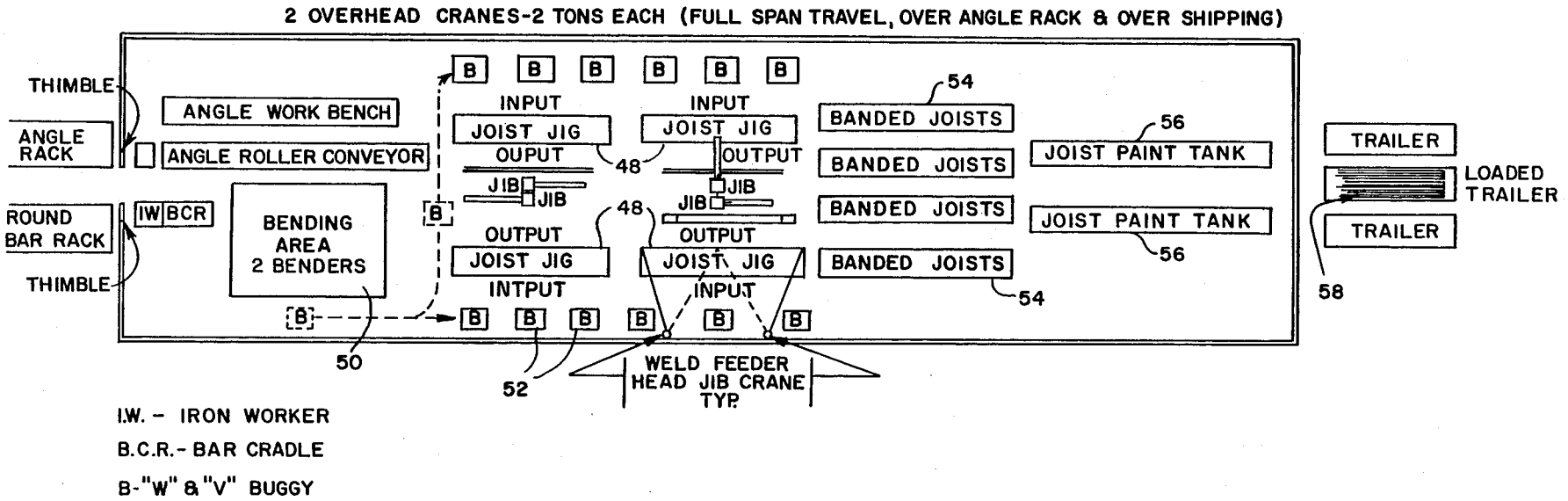
FIG. 10 is a schematic view of a typical layout of a manufacturing shop intended for fabrication of joists in keeping with the present invention.

Referring to FIG. 10, a typical shop or plant for the manufacture of joists according to the present invention is shown. Some of the principal elements of the plant are a bending area 50, a plurality of buggies 52 on which the bar elements 26 and 32 may be placed, and a number of inverters 48 of the nature shown in FIG. 9. The assembly accomplishes an in-line orientation of the joists, from one end to the other of the plant.

Joists may be taken off the inverters 48 and banded in bundles 54, and thereafter painted by dipping in paint tanks 56. After dipping and drying, the fabricated, bundled, painted and tagged joists may be placed on a trailer 58, for delivery to the job site.

There has been described a fabricated open web steel joist. The characteristics of the joist have been discussed in some detail, as has its fabrication. Obviously, reference is "W" may also refer to "M" as to the general configuration of the web members. Other features and alternatives have been discussed. Alternatives may be substituted from the specific matters discussed, without departing from the spirit and scope of the accompanying claims.

What is claimed is:

1. A fabricated open web steel joist having a pair of ends, a top chord at its upper extremity, a bottom chord, at its lower extremity and a web between said to and bottom chords;

said upper and lower extremities being, respectively, at the top and bottom of the joist when the joist is vertically disposed in its normal, load-bearing, orientation;

wherein each of said top and bottom chords comprises a pair of generally L-shaped angles, each having first and second legs, and arranged in back-to-back relation, with the first leg of each "L" being horizontally disposed at the respective upper or lower extremity of the joist, and the second leg of each "L" of each pair of L-shaped angles being vertically disposed and thereby presenting a pair of vertically disposed faces opposed one to the other in said respective pair of L-shaped angles;

and wherein said web is located between said vertically disposed opposed faces of each of said chords, and extends vertically between said chords;

said web being comprised of a plurality of pre-formed bar sections, each of which has a general configuration of a "W", with the ends thereof being located in the top chord in adjacent positions one to another except at the ends of said joist;

said joist being of finite length defined by an integral number of panels along the length of the joist;

wherein each "W" spans two panels along the length of said joist; and wherein, in the event that there are an odd number of panels in the length of the joist, a single "V" is inserted between two "W"'s within the length of the joist, with the ends of said "V" being located in the top chord in adjacent positions to the respective ends of the next adjacent "W"'s between which said "V" is inserted; and wherein said joist is of a welded construction, where each end and each apex of each "W", and said single "V", if included, is welded to each of said vertically disposed opposed faces of said L-shaped angles forming said top and bottom chords.

2. The fabricated joist structure of claim 1, wherein each of said pre-formed bar sections is formed from round bar.

3. The fabricated joist structure of claim 2, wherein each of said pre-formed bar sections is formed from square bar.

4. The fabricated joist structure of claim 1, wherein the included angle between adjacent legs of said W-shaped bar sections, and said V-shaped section when used, and between adjacent ones of said pre-formed bar sections, is in each case along the length of said joist substantially equal to all other such angles in the same joist.

5. The fabricated joist structure of claim 4, wherein each said included angle is in a range of from 40 degrees to 90 degrees.

* * * * *